US011406174B2

(12) United States Patent
Brown

(10) Patent No.: US 11,406,174 B2
(45) Date of Patent: Aug. 9, 2022

(54) INDUSTRIAL STRENGTH KITCHEN GLOVE

(71) Applicant: David C Brown, Killeen, TX (US)

(72) Inventor: David C Brown, Killeen, TX (US)

( * ) Notice: Subject to any disclaimer, the term of this patent is extended or adjusted under 35 U.S.C. 154(b) by 30 days.

(21) Appl. No.: 16/873,766

(22) Filed: Jun. 29, 2020

(65) Prior Publication Data

US 2020/0345127 A1 Nov. 5, 2020

Related U.S. Application Data

(63) Continuation-in-part of application No. 15/530,895, filed on Mar. 17, 2017, now abandoned.

(60) Provisional application No. 62/390,110, filed on Mar. 21, 2016.

(51) Int. Cl.

| | |
|---|---|
| ***A46B 5/04*** | (2006.01) |
| ***A47L 13/18*** | (2006.01) |
| ***A46B 5/00*** | (2006.01) |
| ***A41D 19/00*** | (2006.01) |

(52) U.S. Cl.

CPC ..... *A46B 5/04* (2013.01); *A41D 19/0058* (2013.01); *A46B 5/0029* (2013.01); *A47L 13/18* (2013.01)

(58) Field of Classification Search

CPC ..... A47L 13/18; A47L 17/00; A47L 13/16; A47L 13/19; A47L 23/10; A41D 19/0058; A46B 5/04; A46B 5/002; A46B 5/0025; A46B 5/0029

USPC ..... 15/210.1, 227

See application file for complete search history.

(56) References Cited

U.S. PATENT DOCUMENTS

| | | | | |
|---|---|---|---|---|
| 5,682,837 | A * | 11/1997 | Courtney | A01K 13/002 119/625 |
| 2006/0272116 | A1* | 12/2006 | Thompson | A47L 13/18 15/227 |
| 2008/0301852 | A1* | 12/2008 | Suran | A47L 17/04 2/161.8 |
| 2009/0249573 | A1* | 10/2009 | Ruiz | A47L 13/18 15/227 |
| 2016/0113472 | A1* | 4/2016 | Redd | A47L 13/18 15/118 |
| 2017/0105600 | A1* | 4/2017 | McGrath | A47L 25/005 |
| 2017/0215690 | A1* | 8/2017 | Rumbaugh | A47L 17/00 |

* cited by examiner

*Primary Examiner* — William V Gilbert

(57) ABSTRACT

A water tight rubber glove covering hand, wrist, and mid forearm with scrub pads on top side of glove four fingers. A single pad cut and shaped to cover palm side of glove, four fingers, and bottom side of thumb. Five web pads made into the four fingers a thumb. The four webs are placed at the second bend of each finger to the third bend at bottom of finger. The thumb web is placed at second bend in the thumb to the crease of the thumb.

1 Claim, 2 Drawing Sheets

INDUSTRIAL STRENGTH KITCHEN GLOVE

BACKGROUND OF THE INVENTION

In a restaurant the washing of dishes is usually done by a dishwasher but pre-washing is usually carried out by someone and the need for protecting the hand and forearm of that person is needed. A dish washing glove is used to protect one's hands from hot water and strong soaps and chemicals. Rubber gloves are worn to complete this pre-wash task.

Dishes are clean of heavy food particles then place briefly in hot soapy water then placed in dishwasher.

SUMMARY OF INVENTION

A scrubbing glove with scrub attachments that will remove dried particles of food as dishes are being pre-washed. Scrub pads are placed on palm side and four fingers and thumb. The top side of glove has four strip pads attached to the four fingers.

The object of this invention is to provide improved features in a scrubbing glove that is lightweight in construction, inexpensive to manufacture, and dependable in use. The differences and advantages of this invention will be apparent in the detailed description of the embodiment in the accompanying drawings.

DETAILED DESCRIPTION OF INVENTION

Figure 1:
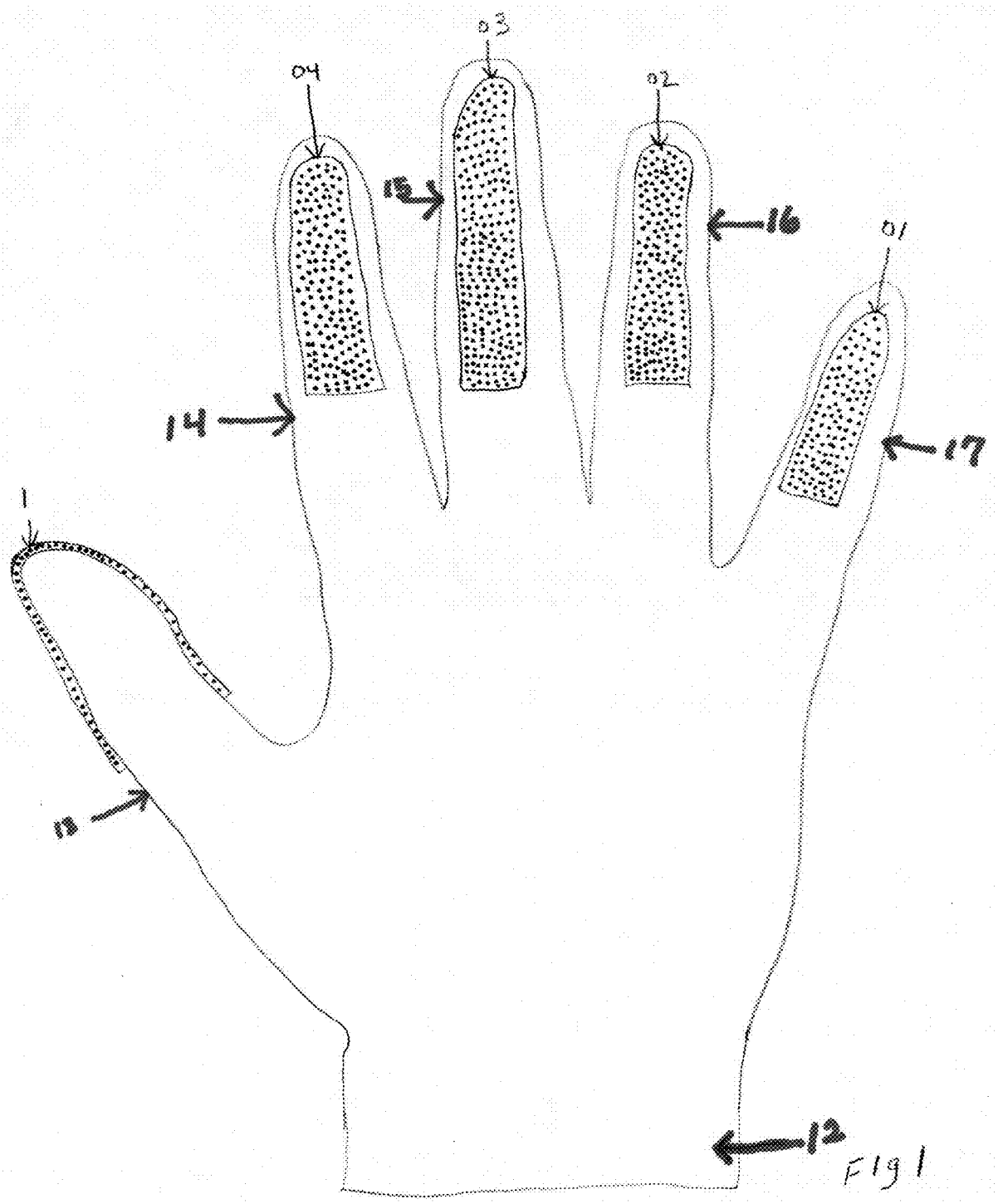
FIG. 1 Top view of scrubbing glove

Referring to FIG. 1 the top view of scrubbing glove 12 for receiving a hand, four fingers and a thumb, wrist, and mid forearm. 12 is glove embodiment. 13 thumb stall. 14 index finger stall. 15 middle finger stall. 16 ring finger stall. 17 little finger stall. 12 Glove embodiment made of latex or rubber waterproof material for protecting hands, fingers, wrists, and mid forearms.

Also referring to FIG. 1 showing four strip scrub pads 01 little finger pad. 02 ring finger pad. 03 middle finger pad. 04 index finger pad. Scrub pads are made of a material, non-abrasive scouring material, known to those skilled in the art which is suitable for scouring dishes and the like.

Figure 2:
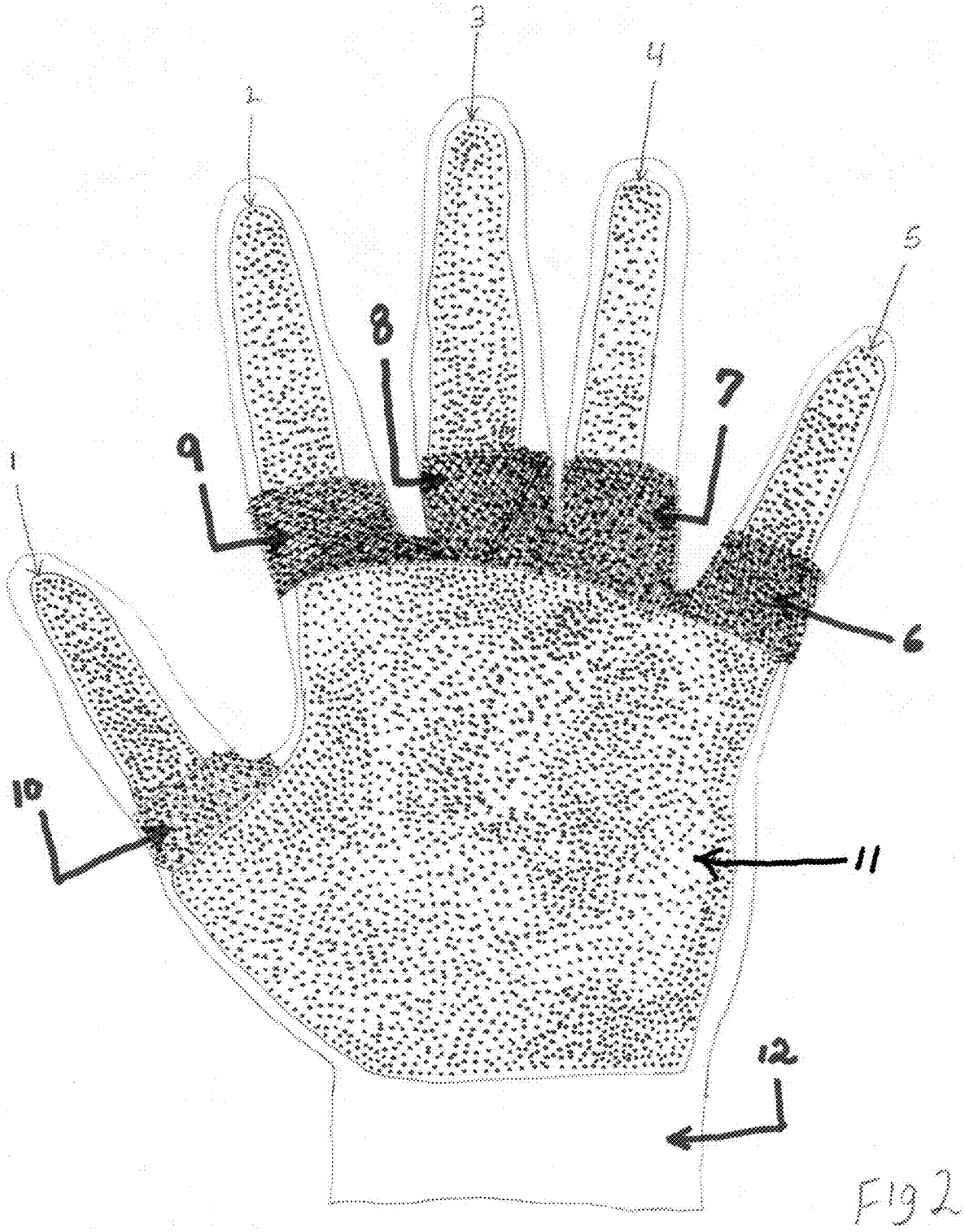
FIG. 2 Is the palm side view of scrubbing glove of FIG. 1

Referring to FIG. 2 is the bottom view of the scrubbing glove FIG. 1

12 for receiving hand, four fingers, and a thumb, wrist, and mid forearm as shown in FIG. 2 12 is glove embodiment 11 is palm pad 1 thumb scrub pad stall 2 index finger scrub pad stall 3 middle finger scrub pad stall 4 ring finger scrub pad stall 5 little finger scrub pad stall The palm side of scrubbing glove is of one total pad cut and shaped to cover the bottom side of palm 11, thumb 1, and four fingers 2, 3, 4, and 5 with an improvement being the web pads 6, 7, 8, 9, and 10 that are not as thick as all other pads which will allow the closing of the hand more tightly around the objects being picked up.

Glove 12 is uniquely different and modifications can be made to it which encompasses any and all gloves within the scope of the following claims.

The invention claimed is:

1. A rubber glove consisting of:

a first section configured to fit around a palm and a back of a hand and a portion of a forearm of a wearer, a first finger stall, a second finger stall, a third finger stall, a fourth finger stall and a thumb stall attached to said first section, each said finger stall and said thumb stall configured to receive a respective finger or thumb of said hand, said first section and said stalls defining a palm side portion and a back hand portion;

said first section, said finger stalls and said thumb stall each consisting of a first scrub pad member on said palm side portion, said first scrub pad members having a first thickness, and a second scrub pad member at a juncture of each said finger stall and said thumb stall to said first section, each said second scrub pad member extending from an edge of said first scrub pad on said palm side portion to a respective one of said first scrub pads on said respective finger stalls and said thumb stall, said second scrub pad members having a second thickness less than said first thickness.

* * * * *